US010119785B2

(12) United States Patent
Fumia et al.

(10) Patent No.: US 10,119,785 B2
(45) Date of Patent: Nov. 6, 2018

(54) DIAMOND SIGHT

(71) Applicant: American Classic Arms, LLC, Wayland, NY (US)

(72) Inventors: David Theodore Fumia, Rochester, NY (US); Ronald Herman Kohlstaedt, Wayland, NY (US)

(73) Assignee: American Classic Arms, LLC, Wayland, NY (US)

( * ) Notice: Subject to any disclaimer, the term of this patent is extended or adjusted under 35 U.S.C. 154(b) by 17 days.

(21) Appl. No.: 15/410,181

(22) Filed: Jan. 19, 2017

(65) Prior Publication Data

US 2017/0205199 A1 Jul. 20, 2017

Related U.S. Application Data

(60) Provisional application No. 62/280,507, filed on Jan. 19, 2016.

(51) Int. Cl.
*F41G 1/00* (2006.01)
*F41G 1/10* (2006.01)
*F41G 1/01* (2006.01)

(52) U.S. Cl.
CPC *F41G 1/10* (2013.01); *F41G 1/01* (2013.01)

(58) Field of Classification Search
CPC ..... F41G 1/02–1/28; F41G 1/32
USPC ..... D22/108
See application file for complete search history.

(56) References Cited

U.S. PATENT DOCUMENTS 3,641,676 A * 2/1972 Knutsen ..... F41G 1/32 42/136
5,065,519 A * 11/1991 Bindon ..... F41G 1/32 42/145
5,426,882 A * 6/1995 Dornaus ..... F41A 17/72 42/137
2006/0207157 A1* 9/2006 Keng ..... F41G 1/32 42/132
2012/0144721 A1* 6/2012 Glimpse ..... F41G 1/02 42/132
2013/0097881 A1* 4/2013 Profos ..... F41G 1/345 33/263

FOREIGN PATENT DOCUMENTS

GB 182274 A * 7/1922 ..... F41G 1/02

OTHER PUBLICATIONS

Armored Jewel's Diamond Gun Sights. <http://www.personaldefenseworld.com/2014/02/armored-jewels-diamond-gun-sights/#armoredjewels-gunsight-glockset>. Feb. 26, 2014.*

* cited by examiner

*Primary Examiner* — Gabriel Klein
(74) *Attorney, Agent, or Firm* — Brian B. Shaw, Esq.; Alfred Y. Chu, Esq.; Harter Secrest & Emery LLP

(57) ABSTRACT

The present disclosure presents a gun sight and a method of forming a gun sight. The gun sight includes a sight body, and a diamond affixed to the sight body at a predetermined location to facilitate aiming. The gun sight may further include a mount, wherein the diamond is retained in the mount and the mount is connected or coupled to the sight body.

9 Claims, 4 Drawing Sheets

DIAMOND SIGHT

BACKGROUND OF THE INVENTION

Field of the Invention

Embodiments of the present disclosure relate to a gun sight of a firearm. The present disclosure relates more particularly to a gun sight with enhanced reflective and light collective capabilities.

Description of Related Art

A sight is a device used to assist a user in aligning or aiming weapons, surveying instruments or other items by eye. Sights can be a simple set or system of markers that have to be aligned together as well as aligned with a target. They can also be optical devices that allow the user to see the image of an aligned aiming point in the same focus as the target. These include telescopic sights. There are also sights that project an aiming point onto the target itself, such as laser sights.

BRIEF SUMMARY OF THE INVENTION

In view of the foregoing, it is an object of the present disclosure to provide a gun sight and method of forming.

A first exemplary embodiment of the present disclosure provides a gun sight. The gun sight includes a sight body, and a diamond affixed to the sight body at a predetermined location to facilitate aiming.

A second exemplary embodiment of the present disclosure provides a method of forming a gun sight. The method includes forming a sight body, and affixing a diamond to the sight body at a predetermined location to facilitate aiming.

A third exemplary embodiment of the present disclosure provides a mount for a gun sight. The mount includes a body having a cavity, the cavity having an open end and a walled end, and a hollow tube affixed within the cavity, the hollow tube having an open side corresponding to the open end of the cavity and an interior side intermediate the open end and the walled end of the first cavity. The mount further includes a diamond affixed within the hollow tube at a location relative to the open side allowing the diamond to receive light from the open side and reflect the light out the open side.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

The present disclosure relates to gun sights and particularly to visual identification in a gun sight. The present system finds particular applicability in low light conditions, in which a user typically encounters difficulty in employing a gun sight to its full advantage.

The term gun sight, or sight, encompasses iron sights, open sights and alignment markers for assisting in aiming a firearm, wherein the term firearm includes, but is not limited to long arms, rifles, pistols and handguns as well as archery devices, including arrow propelling devices.

Embodiments of the present disclosure can be employed on front sights or rear sights, or on both front and rear sights. Generally, embodiments of the present disclosure locates a diamond at a predetermined location on the sight, wherein the light gathering and/or reflecting property of the diamond is used to provide a visual indication of the sight.

In one configuration, the diamond is captured or maintained in a mount and the mount is connected or affixed to a sight body.

Figure 3:
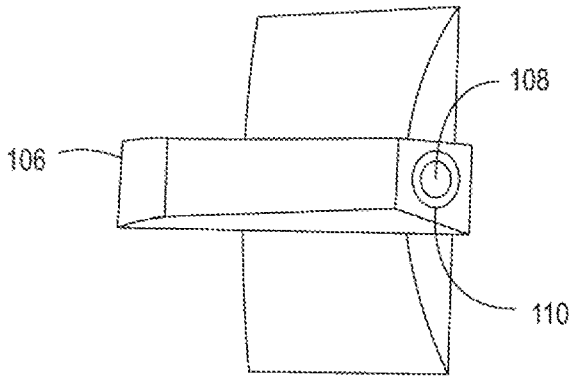
FIG. 3 is a close up view of a front sight suitable for practicing exemplary embodiments of the present disclosure.

In another configuration, the mount is a tube, such as a gold or metal tube, extending along a longitudinal dimension. The diamond is mounted in the tube such that the diamond is longitudinally spaced from at least one end of the tube. The tube is affixed within a cavity the sight body or the mount depending on the embodiment. As seen in FIG. 3, the diamond can be retained in the tube at a location spaced from one end of the tube by at least one diameter of the tube and in certain configurations two to 20 diameters of the diamond.

It is believed advantageous for a gap or space to be located behind the diamond. That is, the diamond is nearer the eye of a user than the gap.

In one configuration, the diamond includes facets for effectively gathering light and reflecting or refracting the light from the surface of the diamond exposed to the user. It is contemplated the mount can be formed of a material providing or can include a reflective surface, wherein incident light is reflected to or toward the diamond.

The sight body includes a seating recess sized to slideably receive the mount. The mount can be engaged with the sight body by any of a variety of mechanisms, including friction fit, adhesives, bonding, welding and selective deformation of a local region of one or both of the mount and the sight body.

In one configuration, the sight body includes an intersecting recess which intersects the seating recess. Through the intersecting recess, the mount can be welded to the sight body. Thus, the diamond is captured within the tubular or cylindrical mount and the mount is received and retained within the seating recess, wherein the diamond is spaced from the internal end of the mount, thereby providing the gap behind the diamond.

The combination of the retention of the diamond in the mount and the capture of the mount in the sight body is sufficient to operably retain the diamond during intended operating conditions, including recoil vibrations and shocks, as well as thermal stresses and changes.

The diamonds can be located on the front sight or the rear sight or both the front sight and the rear sight. In addition, a given sight can include a single or a plurality of diamonds.

Figure 1:
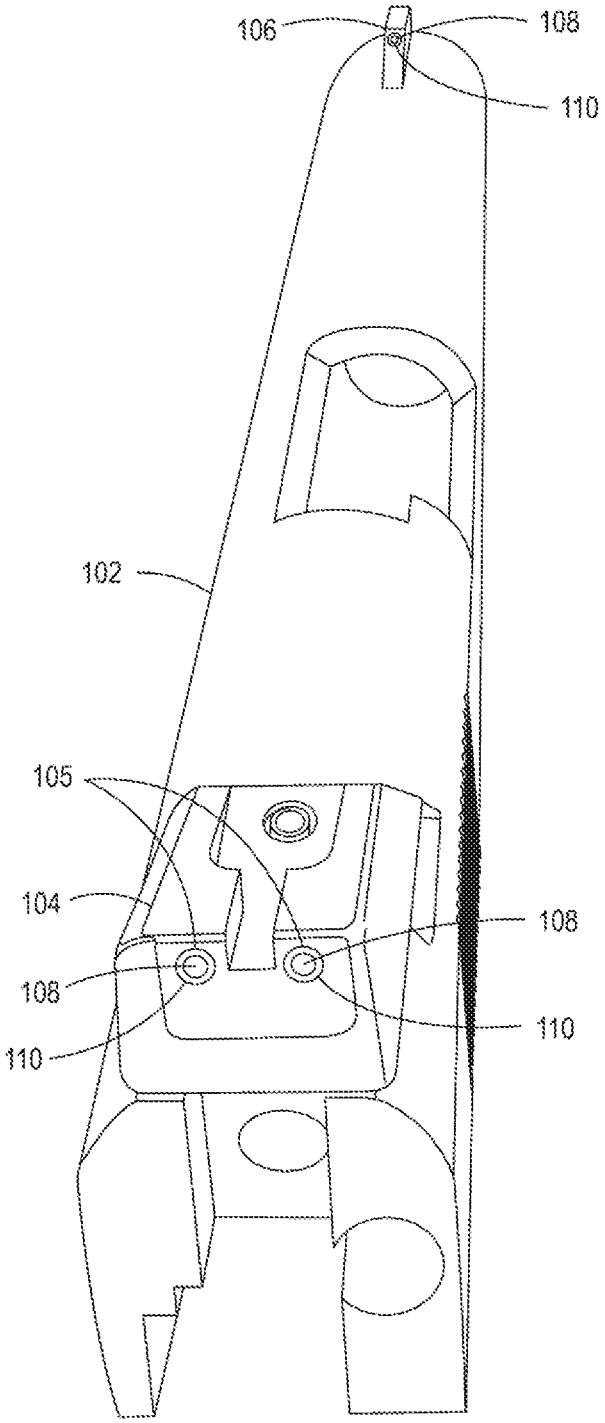
FIG. 1 is a rear view of a sight suitable for practicing exemplary embodiments of the present disclosure.

Referring to FIG. 1 shown is a rear view of a sight suitable for practicing exemplary embodiments of the present disclosure. Shown in FIG. 1 is slide 102 with rear sight 104 and front sight 106. Rear sight 104 can be fixedly attached to slide 102 or it can be removeably attached to slide 102. Rear sight 104 includes diamonds 108 that are maintained in place in rear sight 104 by tubes 110. Front sight 106 also includes a diamond 108 and tube 110 for maintaining diamond 108.

Diamonds 108 are fixedly attached to rear sight 104 through tubes 110, which are fixedly attached to rear sight 104. Rear sight 104 includes cavities 105, which have an open side and a walled side. Tubes 110 are affixed within rear sight 104 in cavities 105 such that tubes 110 have an open side for receiving diamonds 108 corresponding to the open side of cavities 105 and an interior side corresponding to the walled side of the cavities 105. Diamonds 108 are attached to tubes 110 in such a manner to maximize the light reflected properties of diamonds 108. In other words, diamonds 108 are attached to tubes 110 so that they reflect most if not all of the light they receive. Embodiments of diamonds 108 include ideal or round cut diamonds. It should be appreciated that embodiments of diamonds 108 include any type of cut diamond that has light reflective properties, or in other words they reflect light they receive. It should also be appreciated that while embodiments of the present disclosure use diamonds 108, embodiments include use of any gemstone that is operable to reflect light to provide enhanced sight in low light environments.

Embodiments of the present disclosure also include the use of tritium illumination, LEDs, and fiber optics behind the diamonds 108 for enhanced sight in low light environments. That is, a light source such as LEDs, tritium illumination or fiber optics can be located to pass light to the diamonds 108 for reflection/refraction to the user. While cubic zirconia can be used in some circumstances, it has been found that residual machine or gun oil can materially reduce the optical output of the cubic zirconia, thus rendering it less effective.

In one embodiment, diamonds 108 are fixedly attached to tubes 110 by laser welding to reduce the occurrence of residue on the inside surface of diamonds 108, which can reduce the reflective abilities of diamonds 108. Embodiments provide that diamonds 108 are affixed to tubes 110 without the use of glue or any other adhesive such that there is no adhesive residue that inhibits diamond's 108 ability to reflect light.

Embodiments of diamonds 108 and tubes 110 allow for diamonds 108 to be located at any point along the long axis of tubes 108 to either maximize the light reflective abilities of diamonds 108 or to reduce the light reflective abilities of diamonds 108. For instance, it may be expected that a user will use slide 102 primarily during times wherein there is some daylight, as such the maximum amount of light reflected from diamonds 108 is not required and diamonds 108 can be located further within tubes 110 from the surface. It should be appreciated that diamonds 108 are welded within tubes 110 such that a sufficient distance is provided between the distal end (or interior end) of tubes 110 and diamonds 108 thereby providing space for proper welding of the tubes 110 within the mount. In addition, the spacing between the ends of the tubes 110 and the diamonds 108 enhances the optical output of the diamonds 108.

In another instance, a user may expect to use slide 102 in near complete darkness. In this instance, diamonds 108 will be located nearest to the surface of tubes 110 to maximize light reflection.

Figure 2:
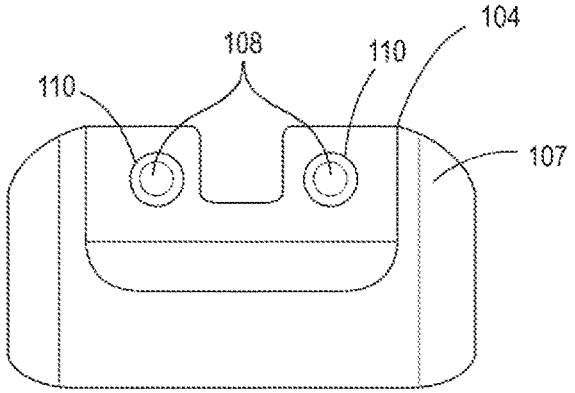
FIG. 2 is a close up view of a rear sight suitable for practicing exemplary embodiments of the present disclosure.
Figure 4:
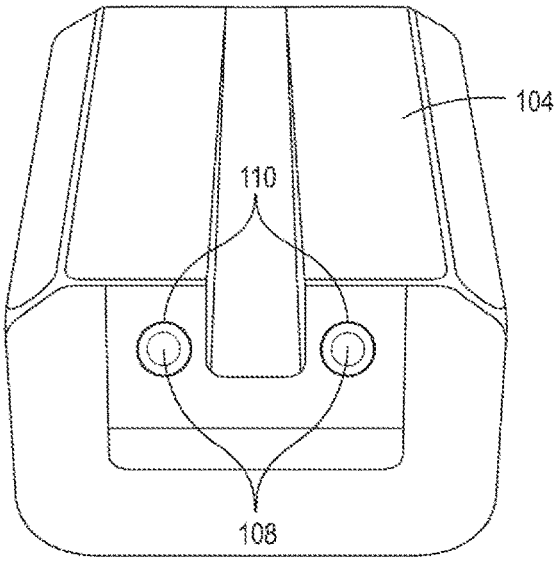
FIG. 4 is a close-up view of the rear sight for practicing exemplary embodiments of the present disclosure.

Referring to FIG. 2 and FIG. 4, shown is a close up view of a rear sight suitable for practicing exemplary embodiments of the present disclosure. Shown in FIG. 2 is rear sight 104 with diamonds 108 and tubes 110. The diamonds are retained within the tubes at a location to provide for laser welding of the tubes to the mount, through an access port 107 in the mount. That is, the mount includes an access port for receiving laser energy to impact the tube and bond the tube to the mount, without impacting the retention of the diamond in the tube.

Figure 5:
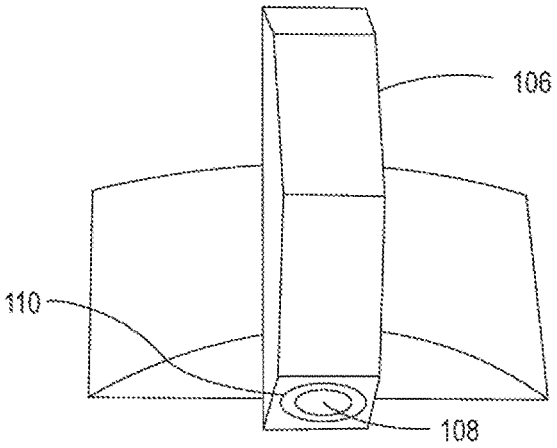
FIG. 5 is a close-up view of a front sight for practicing exemplary embodiments of the present disclosure.

Reference is now made to FIG. 3 and FIG. 5, which depict a close up view of a front sight suitable for practicing exemplary embodiments of the present disclosure. Shown in FIG. 3 is front sight 106 and diamond 108 with tube 110.

Figure 6:
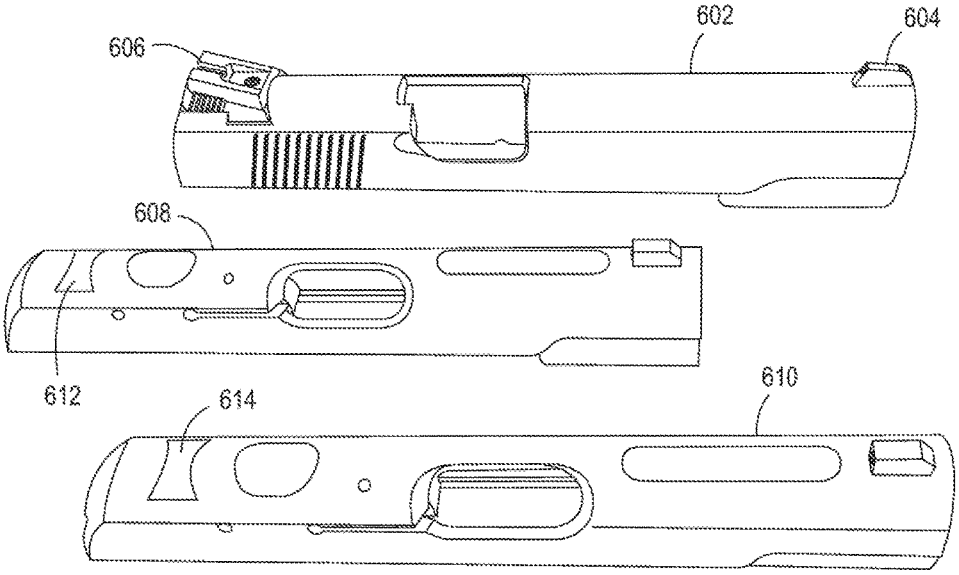
FIG. 6 is a side view of multiple slides suitable for practicing exemplary embodiments of the present disclosure.

Referring to FIG. 6 shown is a side view of multiple slides suitable for practicing exemplary embodiments of the present disclosure. Each of the sights depicted include a diamond sight as described herein. It should be noted that slide 602 includes a front sight 604 and a rear sight 606, however, slides 608 and 610 do not include a rear sight. Slides 608 and 610 include a recess 612 and 614, respectively, for attachment to a rear sight.

Figure 7:
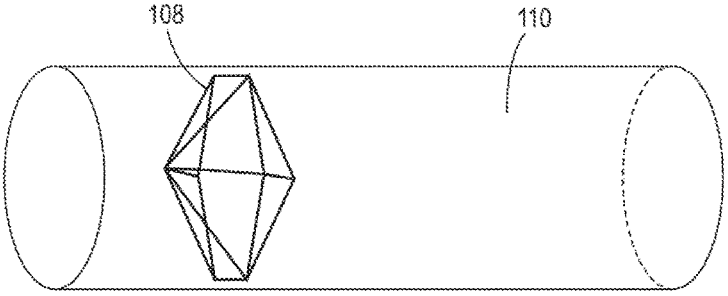
FIG. 7 is a side view of an exemplary mounting tube for practicing exemplary embodiments of the present disclosure.

Referring to FIG. 7, shown is a side view of an exemplary mounting tube for practicing exemplary embodiments of the present disclosure. Shown in FIG. 7 is diamond 108 located within tube 110. Tube 110 has a long axis along which diamond 108 can be affixed. Accordingly, embodiments of the present disclosure contemplate diamond 108 being affixed anywhere along the long axis of tube 110.

Embodiments of the present invention have been described in detail with particular reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A mount for a gun sight, the mount comprising:

(a) a sight body having a cavity, the cavity having an open end and a walled end;

(b) a hollow tube affixed within the cavity, the hollow tube having an open side corresponding to the open end of the cavity and an interior side intermediate the open end and the walled end of the cavity; and (c) a faceted diamond affixed and recessed within the hollow tube and disposed at a location intermediate the open side and the interior side allowing the faceted diamond to receive light from the open side and reflect the light out the open side.

2. The mount according to claim 1, the mount further comprising a second cavity spaced from the cavity, the second cavity having a second open end and a second walled end; a second hollow tube affixed within the second cavity, the second hollow tube having a second open side corresponding to the second open end of the second cavity and a second interior side intermediate the second open end and the second walled end;

and a second diamond affixed within the second hollow tube at a second location intermediate the second open side and the second interior side allowing the second diamond to receive light from the second open side and reflect the light out of the second open side.

3. The mount according to claim 1, wherein the mount is operable to be removably attached to a firearm.

4. The mount according to claim 1, wherein the mount is affixed to a firearm.

5. The mount according to claim 1, the mount further comprising at least one access port operably connected to the cavity, wherein the access port is operable for retaining the hollow tube relative to the sight body.

6. A mount for a gun sight, the mount comprising:

(a) a sight body having a cavity, the cavity having an open end and a walled end;

(b) a hollow tube affixed within the cavity, the hollow tube having an open side corresponding to the open end of the cavity and an interior side intermediate the open end and the walled end of the cavity;

(c) a faceted diamond having a diameter and affixed within the hollow tube at a location relative to the open side allowing the faceted diamond to receive light from the open side and reflect the light out the open side; and (d) at least one access port operably connected to the cavity, the access port being operable for affixing the hollow tube to the mount, wherein the hollow tube has a length of at least the diameter of the faceted diamond, the length of the hollow tube providing a gap between the faceted diamond and the walled end of the cavity.

7. The mount according to claim 6, the mount further comprising a second cavity spaced from the cavity, the second cavity having a second open end and a second walled end; a second hollow tube affixed within the second cavity, the second hollow tube having a second open side corresponding to the second open end of the second cavity and a second interior side intermediate the second open end and the second walled end; and a second diamond affixed within the second hollow tube at a second location relative to the second open side allowing the second diamond to receive light from the second open side and reflect the light out of the second open side.

8. The mount according to claim 6, wherein the mount is operable to be removably attached to a firearm.

9. The mount according to claim 6, wherein the mount is affixed to a firearm.

* * * * *